US005997151A

United States Patent [19]

Douglass, II

[11] Patent Number: 5,997,151

[45] **Date of Patent: *Dec. 7, 1999**

[54] ILLUMINATING MOBILE

[76] Inventor: Myrl Rae Douglass, II, 191 Mano Dr., Kula, Maui, Hi. 96790

[ * ] Notice: This patent is subject to a terminal disclaimer.

[21] Appl. No.: 08/934,910

[22] Filed: Sep. 22, 1997

Related U.S. Application Data

[63] Continuation-in-part of application No. 08/735,069, Oct. 18, 1996, Pat. No. 5,791,775

[60] Provisional application No. 60/005,742, Oct. 20, 1995.

[51] Int. Cl.[6] ..... F21V 21/02

[52] U.S. Cl. ..... 362/239; 362/250; 362/404; 362/427

[58] Field of Search ..... 362/35, 238, 239, 362/250, 269, 283, 249, 252, 351, 404, 405, 427; 40/430–432, 473, 480; 446/242; D11/141

[56] References Cited

U.S. PATENT DOCUMENTS

| | | | |
|---|---|---|---|
| 4,449,169 | 5/1984 | Warshawsky | 362/239 |
| 4,734,830 | 3/1988 | Cristian et al. | 362/35 |
| 4,745,526 | 5/1988 | Sestak | 362/35 |
| 5,709,461 | 1/1998 | Michl et al. | 362/239 |
| 5,791,775 | 8/1998 | Douglass, II | 362/806 |

*Primary Examiner*—Alan Cariaso
*Attorney, Agent, or Firm*—Garvey, Smith, Nehrbass & Doody, L.L.C.

[57] ABSTRACT

A decorative illuminating mobile apparatus includes a support member that has an engaging surface that fits a generally flat adjacent anchoring surface such as a ceiling, floor, wall or the like. A first swivel member extends away from the support member. A plurality of separately rotatable appendages are connection sequentially together by a series of addition swivel members that space each appendage a part from another adjacent appendage and away from the support member engaging surface. This arrangement stacks the rotatable appendages vertically so there is a highest appendage and a lowest appendage with a plurality of appendages therebetween for example. At least some of the appendages include a light source that is powered by electricity. An electrical supply is provided for illuminating each light source, the electrical supply including rotational light electrical supply connection at the swivels. At least a plurality of the appendages have two rotational connections that are spaced apart along the length of the appendage to ensure a non-coaxial rotation of each appendage relative to its adjacent appendages.

20 Claims, 17 Drawing Sheets

ILLUMINATING MOBILE

This is a continuation-in-part of of U.S. patent application Ser. No. 08/735,069, filed Oct. 18, 1996 now U.S. Pat. No. 5,791,775. This application also claims priority of U.S. Provisional Patent Application Ser. No. 60/005,742, filed Oct. 20, 1995. Both of these applications are hereby incorporated by reference, as is U.S. Provisional Patent Application Ser. No. 60/055,473, filed Aug. 12, 1997.

BACKGROUND OF THE INVENTION

1. Field of the Invention

The present invention relates to kinetic wind driven mobiles that include a luminair for providing useful indirect room lighting. More particularly, the present invention relates to an improved decorative illuminating light mobile apparatus that includes a support member affixable to a floor, wall, ceiling, or the like, a first swivel that extends away from the support member, and a plurality of serially stacked and connected appendages that are independently rotatable with respect to an adjacent appendage in a non-axial fashion. At least some of the appendages include a light source that is powered by electricity. At least a plurality of the appendages have two rotational connections that are spaced apart along the length of the appendage.

2. General Background

Kinetic art has been around since the turn of the century. The artist Alexander Calder invented what has commonly been called the mobile. A mobile can be defined as a decorative, three dimensional art object mounted in a hanging position and is free to move in any of its planes. The mobile has pleased countless amounts of people with its ability to transform itself into an infinite amount of configurations holding ones interest the same as the sight of clouds on a lazy summer day.

The effect can also be quite soothing and almost mesmerizing because it transforms itself gracefully with the slightest breeze.

Patents have issued for mobiles and artistic sculptures having a series of independently rotating arms some of which carry light emitting sources (e.g. candles).

One mobile is a design patent to Blake (U.S. Pat. No. Des. 229,576 issued 1973), which shows a "candle chandelier mobile" in which a calder-type mobile includes a number of somewhat independently movable, laterally extended arms (e.g. two or four), each of which carries at least one candle at the end of the arm or candles at both ends of each arm. Presumably the moving candles would create changing patterns of light on the ceiling, if there was a feature that was built into the design that would cause it to move with ambient air currents. In the '576 patent, a mechanical chandelier device uses S-hooks to form connections between each of a plurality of beams wherein the lowest beam has a counterweight in one embodiment and wherein each beam supports a candlestick at one end. In a second embodiment, there are two beams that are connected with a cable that is pinned or bolted to brackets that attach to horizontal beams having candlesticks at each end. The arms of the design are made of nothing more than metal rods with little surface area to catch the wind, and there is no provision to shield the candle flame from being extinguished from the wind necessary to move the arms of the mobile. It is unlikely that this device could be moved to change shape with anything other than a direct and steady human touch.

The novelty and desirability of producing light patterns on a ceiling using electric lights was noted in the patent to Cilurzo (U.S. Pat. No. 2,818,770 issued in 1958), which discloses the use of such a light inside a container with a lens at its upper end. Cilurzo also suggest a combined use of a plurality of such "mood" lights "mounted together on a standard by swivel means" (col. 4, lines 21+). This design relies on a fixed lens mounted next to the light source in the same way that a movie projector is configured.

A support for holding candles and the like is disclosed in U.S. Pat. No. D 275,627. In the '627 patent, hooks attach one ring to another ring so that a plurality of rings are spaced vertically apart. Each ring carries a support that can hold a plant or candleholder.

A mobile ornament is disclosed in U.S. Pat. D 171,594 wherein one of the members is an elongated triangular shaped appendage that supports other articles from its two end portions with cables.

A lighted fiberoptic mobile is disclosed in U.S. Pat. No. 5,029,047. In the '047 patent, the mobile has objects or characters attached to its appendages and can emit active (twinkling or sequencing) colorful light. This is accomplished by utilizing optic fibers to transmit light from a light source in the mobiles central housing to objects or characters or a given location on the appendages. The light is made active and colorful at the output end of the optic fibers by placing a light influencing slide between the light source and the input end of the revolving optic fibers that are routed from the appendages and are grouped together in front of the light source. Four arms extend radially from a central hub. Each of the arms carries a single star. The stars are at the same elevation and the stars do not support additional portions of the mobile. This differs from the present invention in that the present invention uses a series of vertically stacked and separated appendages each of which carries a light source and each of which rotates 360 degrees with respect to the other appendages in a non-coaxial fashion.

Other patents possibly relevant to the present invention include U.S. Pat. No. 4,459,645 entitled "Illuminating Earring with Coaxial Conductor Arrangement". The '645 patent includes a light emitting diode (LED) mounted upon a base. A battery containing cases electrically and mechanically connected to the base through a hollow shaft and conductor coaxial arrangement dimensioned to pass through a hole in a pierced ear so that current flow between the LED and the batteries takes place only through the hole in the ear when the earring is worn and operational.

U.S. Pat. No. 2,818,770 issued to V. F. Cilurzo provides a "Abstract Pattern Lamp Projecting Means".

SUMMARY OF THE INVENTION

The object of this invention is to cause a wind driven mobile to emit useful indirect lighting thus creating an ever-changing display of light on a visible surface that would also provide sufficient ambient light for its surroundings.

The arms or appendages of the mobile conceal a lamp (e.g. a spotlight) that is powered electrically from a remote source. Electric Current is transferred to the appendages through a co-axial swivel that allows complete and multiple rotations of the appendages about one another without the tangling of electrical wires.

The surface directly illuminated by the mobile is transformed into a slowly changing mosaic of light patterns.

The illuminating mobile of the present invention consists of a number of appendages, each with its own source of electric illumination. Each appendage is balanced off of and free to rotate about each other, as ambient air currents pass across the device, so that an infinite amount of configurations and lighting effects may be generated.

This is accomplished by using a co-axial electrical swivel to pass electricity from one appendage to the other that will permit a full 360 degree rotation yet maintain steady electrical contact in both polarities while minimizing rotational friction.

Each appendage can be designed to house the electrical light source in a way that will provide indirect illumination, yet project the light on a surface that is readily seen, and have enough exposed surface area to act as a sail to catch ambient air currents. For example, as an option this can be accomplished either by providing an appendage with divergent flared sides where the entire body of the appendage provides enough surface area to cause the appendage to rotate about its axis, or by attaching a wind catching device (fin) to the light source with a balancing arm.

The illuminating mobile may be configured to mount on the ceiling, wall, or on a pedestal for floor or table use, and may also be used outdoors with sufficient moisture proofing. Two basic variations of the mobile are shown in the ceiling hung configuration. Each use the same co-axial swivel, but have the two different variations of the appendage design as discussed.

The apparatus can be configured as a wall sconce, table, and floor mounted fixture. All of the variations preferably use 12 volt DC current, with one polarity of current carried directly through the framework of the appendage. An alternate swivel design for 120 volt AC current is also shown. In this version both polarities are completely insulated from the appendage.

Low voltage lighting is preferred because of its compact and intense quality, and the more compact and simple coaxial swivels.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

Figure 3:
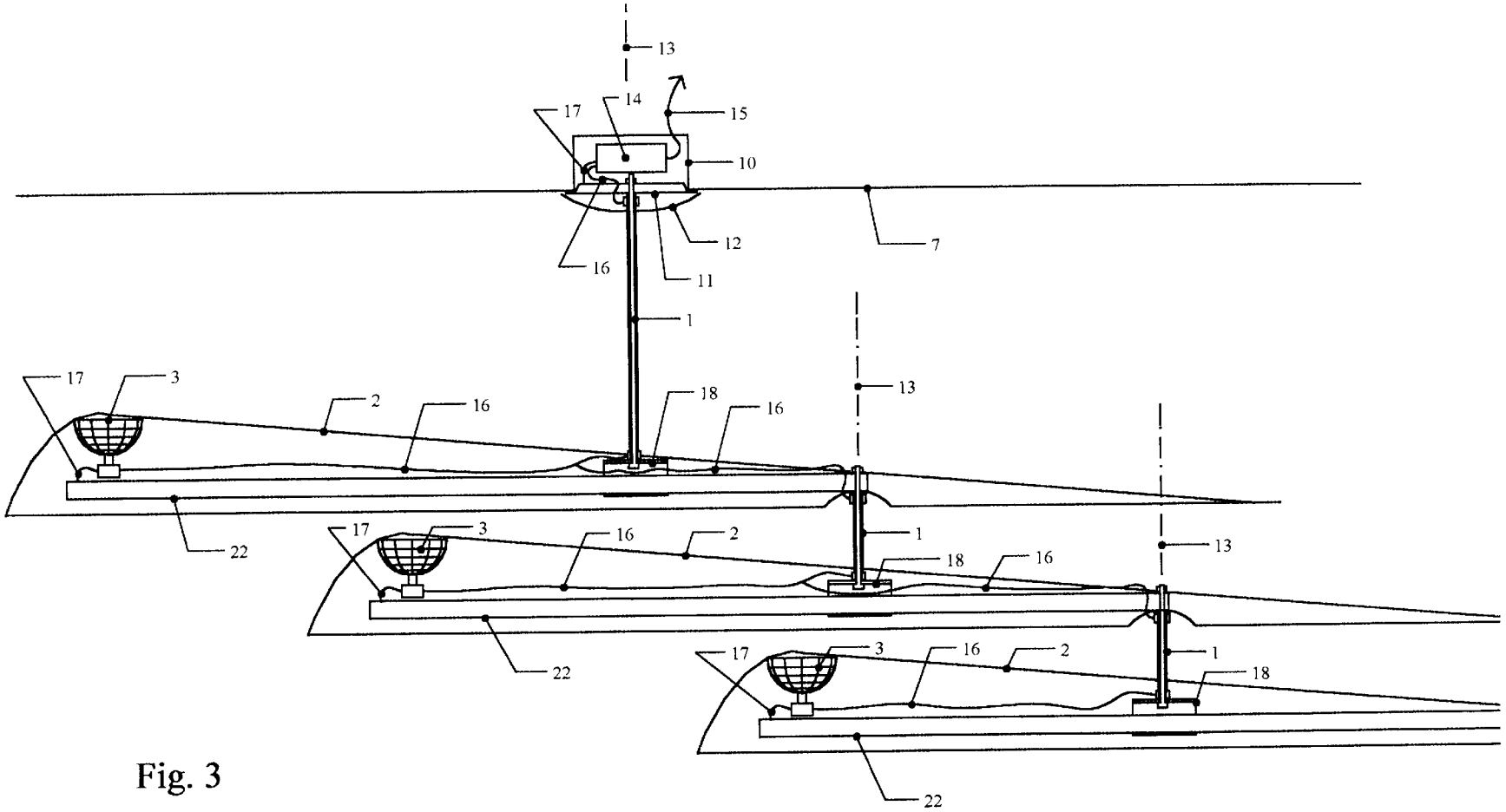
FIGS. 3 and 4 are respectively longitudinal sections of each of the embodiments showing basic components and wiring.
Figure 4:
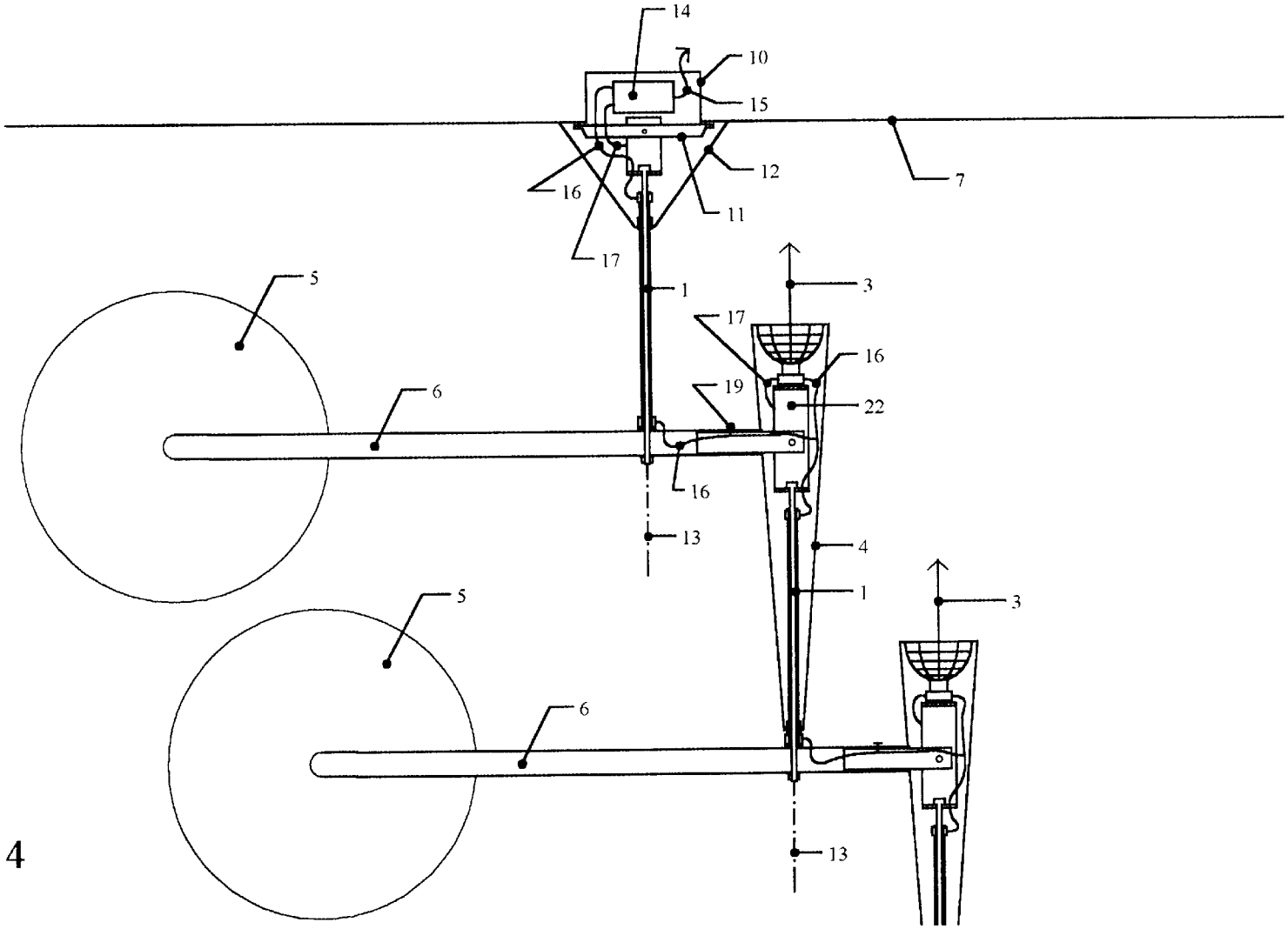
Figure 5:
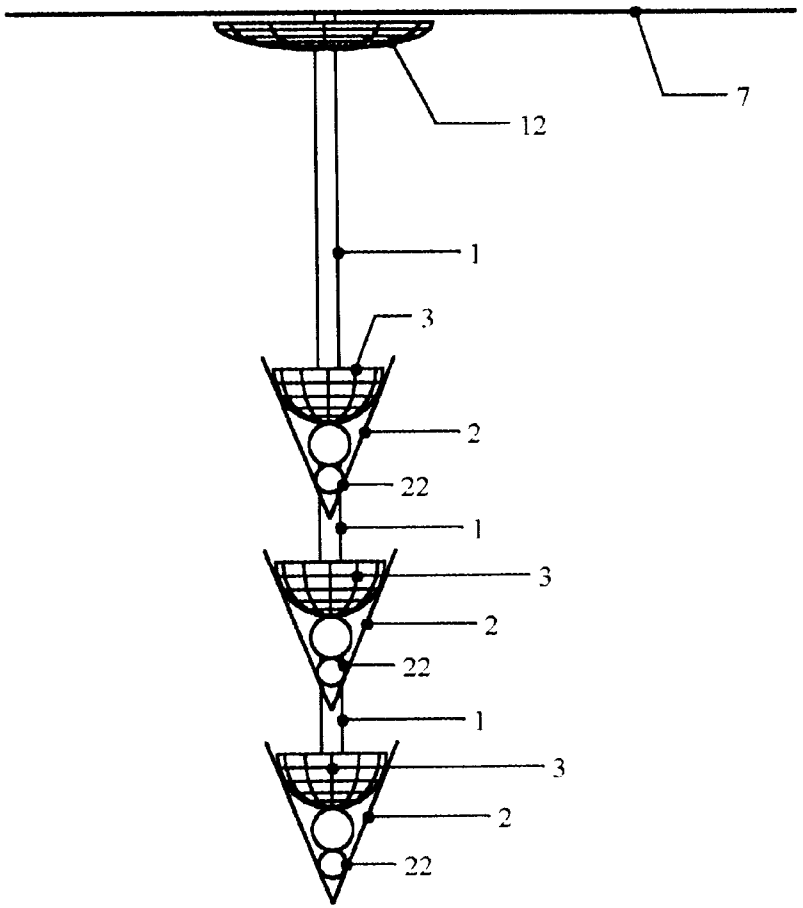
FIG. 5 is a cross section of first embodiment showing basic components and relationship of body to framework.

DETAILED DESCRIPTION OF THE PREFERRED EMBODIMENT:

As shown in FIGS. 1–7, the basic components of each embodiment of the illuminating mobile are a co-axial swivel 1, mobile appendage 2, and the light source 3. In one version the appendage 2 consists of two divergent solid planes that are angled, preferably not more than 45 degrees from each other both mounted to an internal tubular framework 22, as shown in FIG. 5. This allows the sides to be at an angle steep enough to catch the wind, yet provide enough flair to fully conceal the light source.

In another version, the appendage consist of three parts. A decorative cone 4 is designed to conceal both the light source and the co-axial swivel. A vertical fin 5 is designed to catch the wind. A hollow tube 6 connects the decorative cone 4 with the fins and also provide a point of attachment for the coaxial swivel of the next appendage along with a concealed space for the electrical wires, as shown in FIG. 4. The apparatus of the present invention shall be shown herein in the ceiling hung configuration, and the ceiling will be used as the surface receiving the direct illumination from the spot light sources 7. One version shall be shown in the wall and pedestal mounted configurations.

Figure 1:
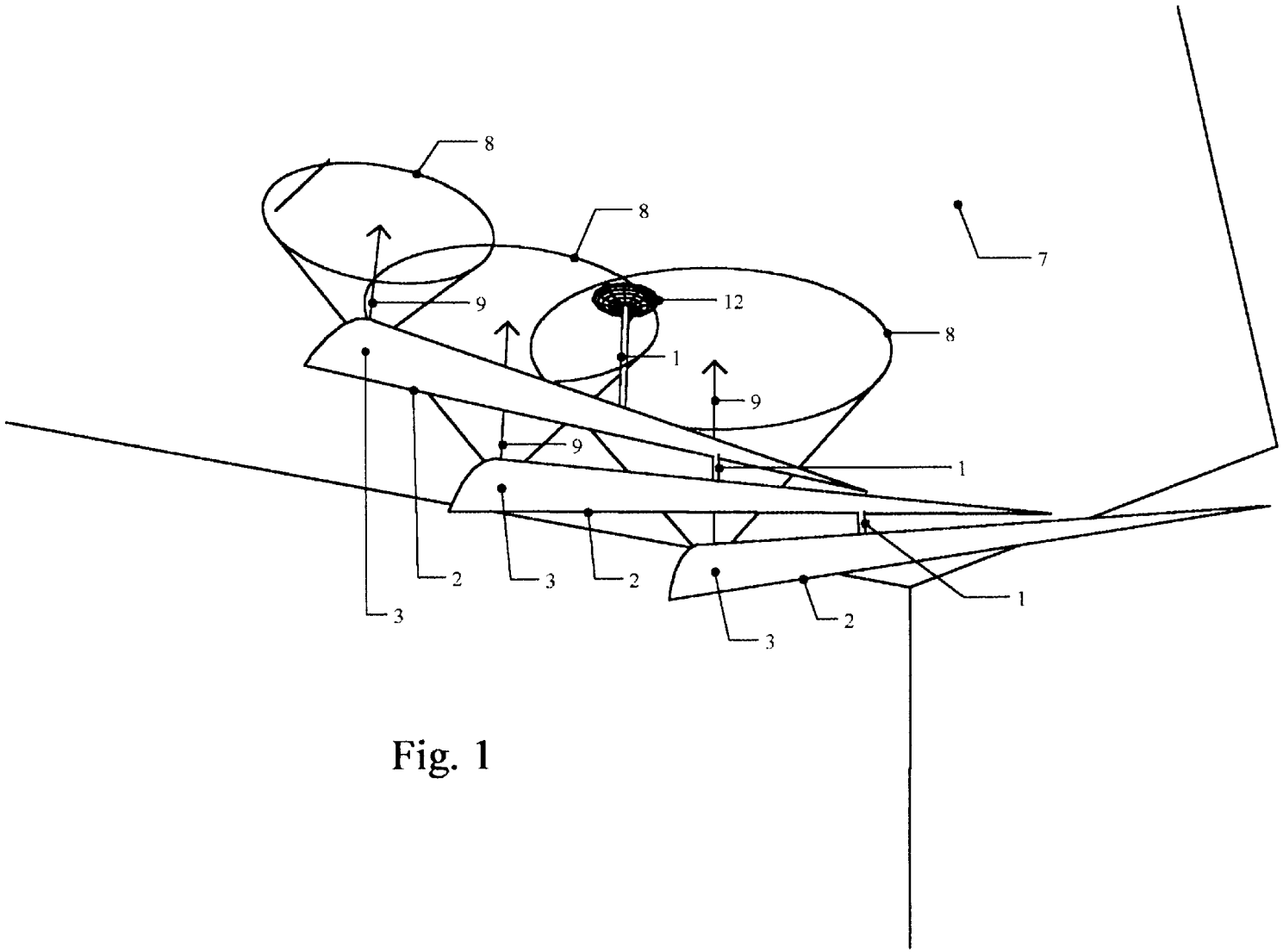
FIG. 1 is a perspective drawing of first embodiment the illuminating mobile showing its basic components and lighting effects.
Figure 2:
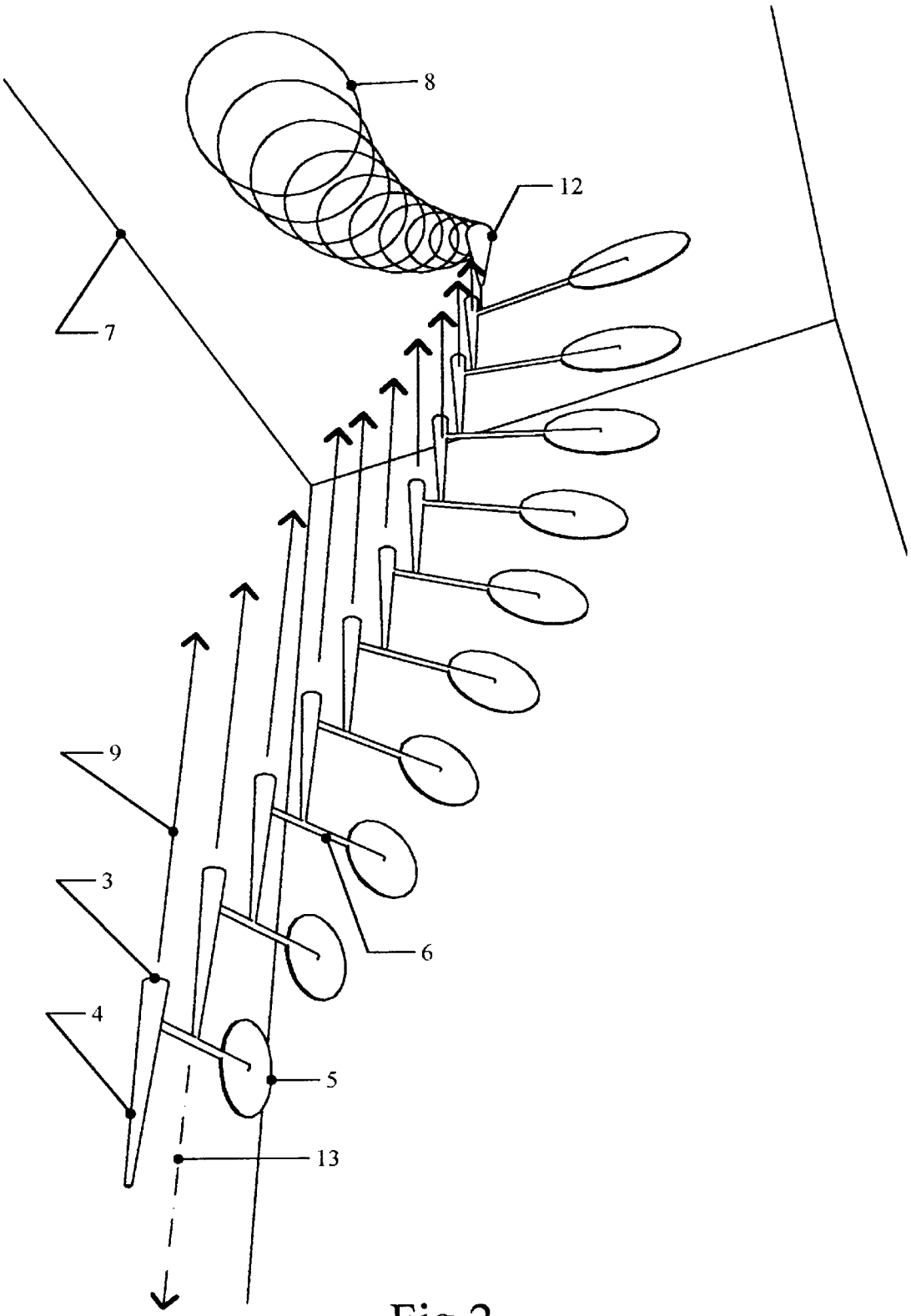
FIG. 2 is a perspective drawing of second embodiment of the illuminating mobile showing its basic components and lighting effects.

In FIGS. 1 and 2 the light cones are outlined at 8 as they hit the ceiling in both embodiments and an arrow 9 defines the path of light from its source. The fixtures are attached to the ceiling at a traditional J-box 10, where a co-axial swivel 1 will be secured onto a bracket 11 designed to screw into the J-Box 10 mounted firmly into the ceiling structure. This point of connection can be concealed with a decorative cover 12. The co-axial swivel allows free rotation around the axis of each appendage 13. This allows an infinite variety of configurations for the appendages, as they orbit around each other, producing an infinite variety of lighting effects, some of which are shown in FIGS. 1, 2.

Figure 6:
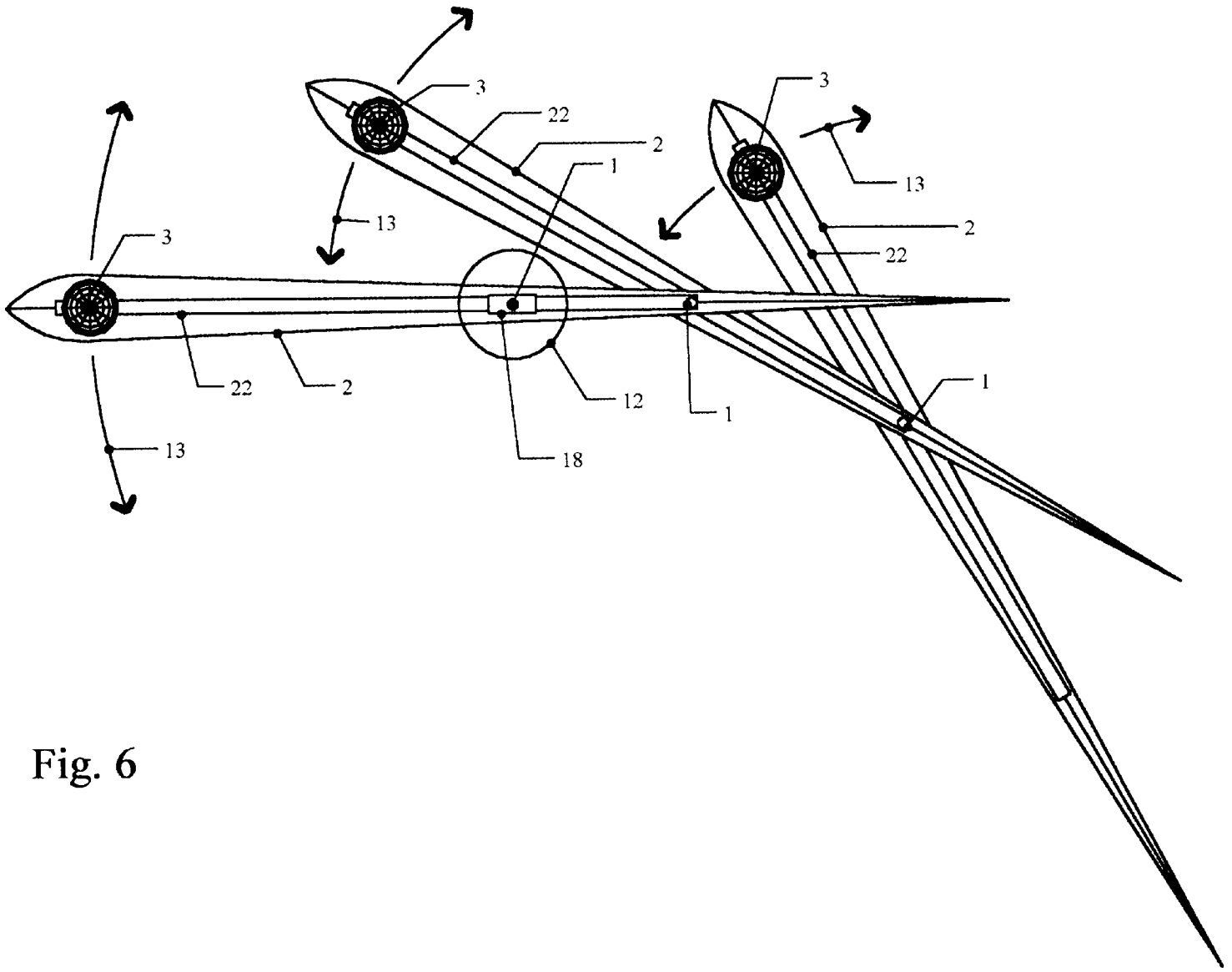
FIGS. 6 and 7 are respective plan views of each of the embodiments showing rotation and basic components.
Figure 7:
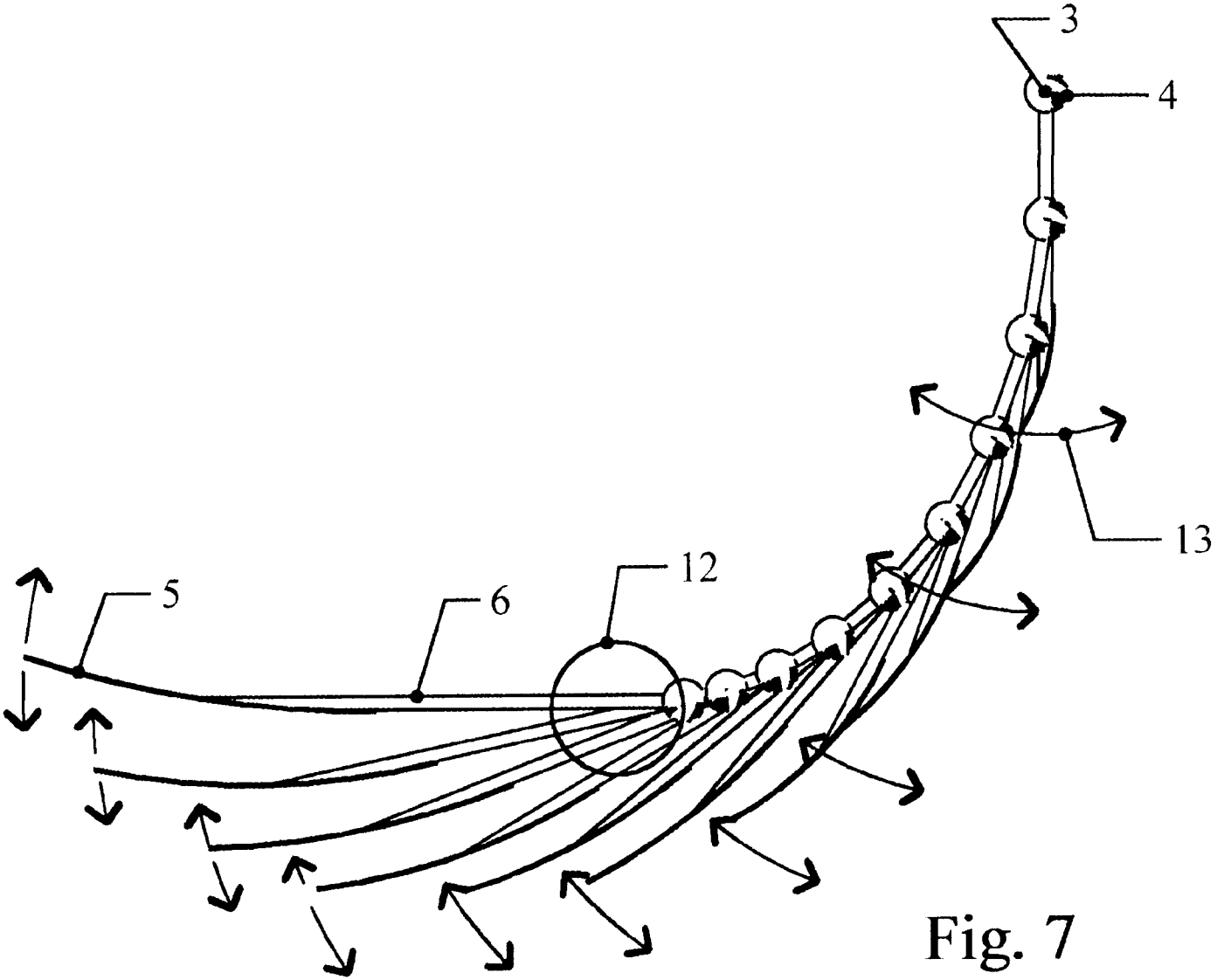
Figure 9:
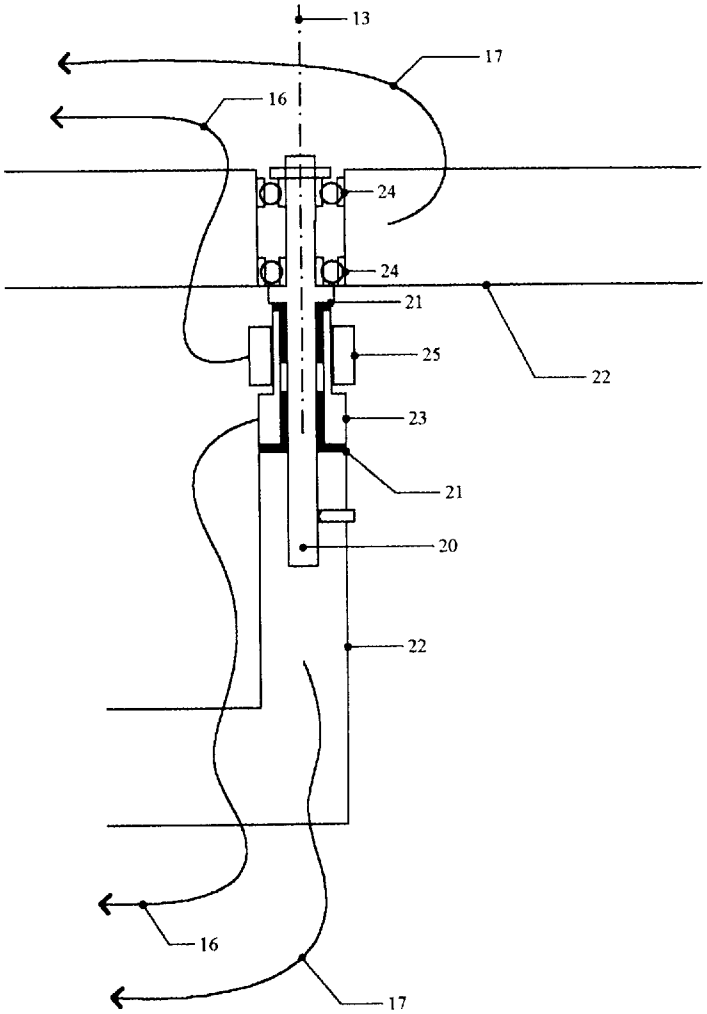
FIG. 9 is an enlarged cross section of the co-axial electrical swivel used in the low voltage wall and pedestal mounted configurations.
Figure 8:
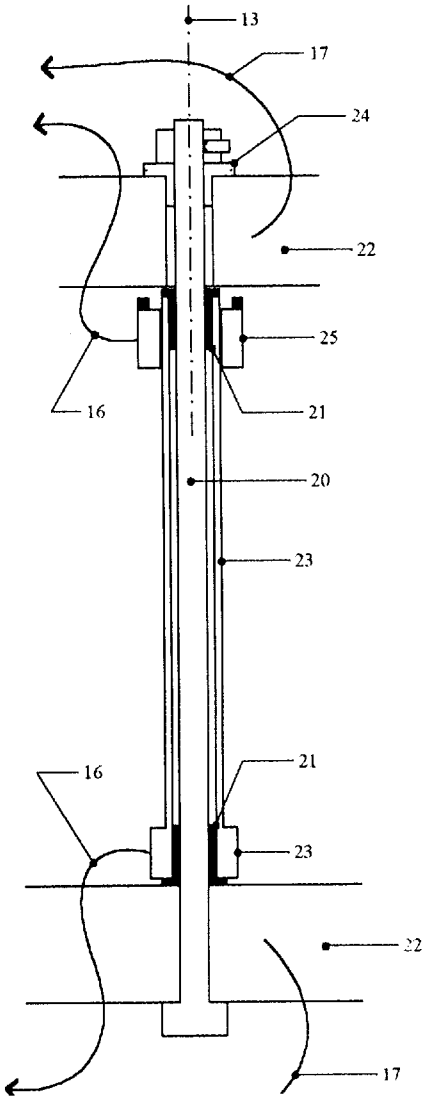
FIG. 8 is an enlarged cross section of the co-axial electrical swivel used in the low voltage ceiling hung configurations.
Figure 11:
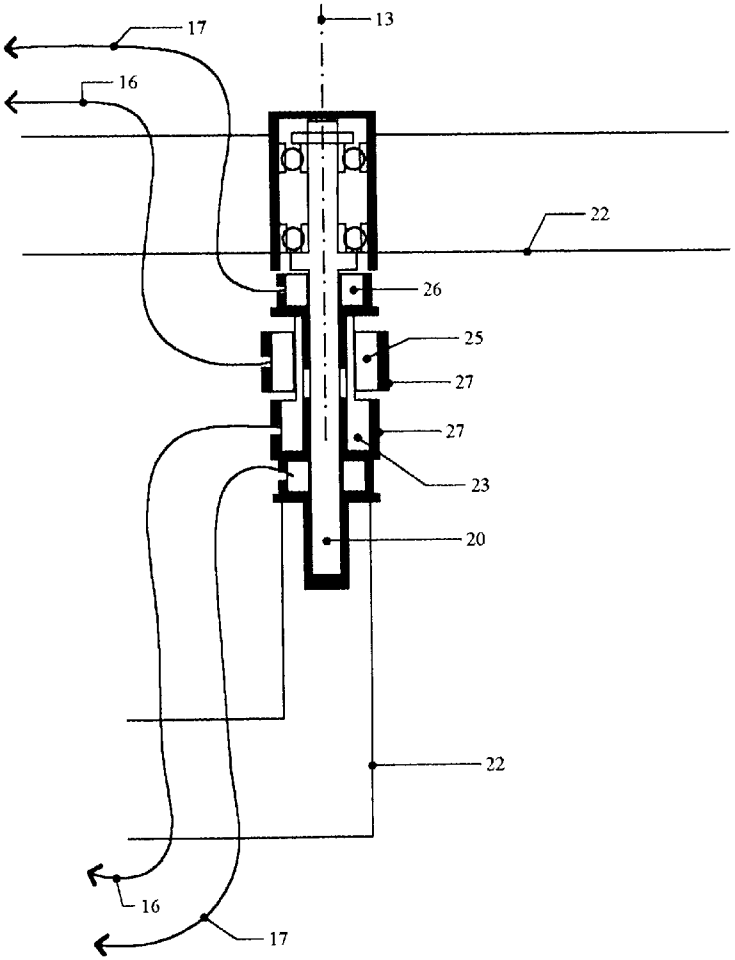
FIG. 11 is an enlarged cross section of the co-axial electrical swivel used in the 120 volt AC wall and pedestal mounted configurations.
Figure 10:
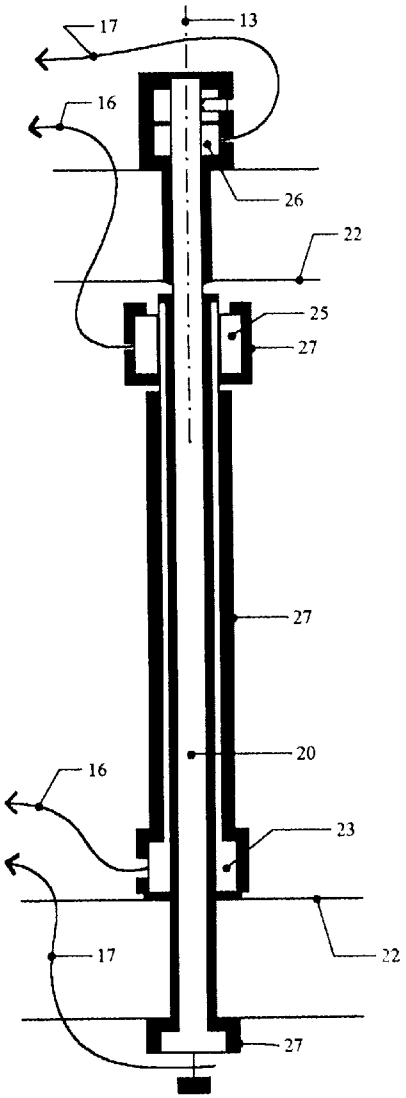
FIG. 10 is an enlarged cross section of the co-axial electrical swivel used in 120 volt AC ceiling hung configurations.

A light source can be low voltage quartz bulbs which require a remote 120VAC-12VDC transformer 14. This transformer 14 will be fed by 120 volts AC supply line 15 and will discharge 12 volts DC with sufficient wattage the requirements of the combined load of the halogen light sources. The 12 volt DC wiring (16 positive polarity lead, 17 negative polarity lead) should be sized of a sufficient gauge the demands of the DC load. As shown in FIGS. 6, 7, each appendage of the illuminating mobile is free to rotate about each other at the point of connection for each appendage 13, where the coaxial swivels 1 are used to make the connection.

The appendages in all embodiments should be perfectly balanced about each other to insure proper rotation and orbit about each other. The balance may be precisely adjusted by either altering the position of the fulcrum along the length of the appendage, or by altering the position of lead weights concealed within the appendage. In the ceiling hung version of the first embodiment, balance is achieved by sliding the point of connection of the swivel 18, as shown in FIG. 3, along the tubular framework 22. In the second embodiment the length of the hollow tube 6 may be adjusted with telescopic tubing 19, as shown in FIG. 4, to lengthen the moment arm thus altering the position of the fulcrum point.

The coaxial electrical swivel is designed to allow unencumbered circular rotation about one axis while maintaining full bi-polar electrical contact. The basic components of the swivel are shown in FIGS. 8–11 that show variations for ceiling and non ceiling hung versions, and variations for 12V DC and 120 Volt AC. These consist of a central shaft 20 that can be made of copper or brass, an insulating sleeve 21 that can be made of Teflon, and a copper or brass tube 23. One pole of current is carried through the central shaft 20 while the other is carried through the walls of the brass tube 23.

One end of the central shaft 20 is connected to (but free to rotate about) the body 2 and/or frame 22 of one appendage with a bearing assembly 24. The other end of the shaft 20 is directly attached to the frame of the other appendage. In the 12V DC embodiment one pole of the electric current is conducted from each end of the shaft directly into the frame of each appendage 22. Because of this, the bearing assembly 24 must be made out of a conductive material.

The end of the brass tube 23 that coincides with the fixed end of the central shaft 20 is attached directly to the wiring of the appendage at that end 16. Both the tube 23 and the shaft 20 are in fixed rotation with that appendage. The wiring from the opposite appendage 16, is connected to a brass slip-ring 25 sized to slide freely enough about the brass tube 23 to minimize rotational friction, but not too loose as to impede electrical contact. In most cases sufficient electrical contact is made between the slip ring 25 and the brass tube 23 by the weight and geometry of the slip ring in relation to the sprung tension inherent in the copper wire of the electrical lead 16, but for higher wattages a small compression spring with mounting bracket may be added to hold the inner wall of the slip ring 26 more firmly against the outer wall of the tube 23.

In the 12V DC versions the gauge of the tubing 23 and the size of the slip-ring 25 must be sized according to the combined wattage of the light bulbs. This is important in low voltage applications because too much impedance can cause the swivel to overheat. In the swivels designed for 120V AC, both polarities are insulated from the appendage framework 22, so an additional slip-ring 26 sized to fit over the central shaft 20 must be added. Do to the shock hazard of 120V AC, the exposed sides of the brass tube 23 along with both slip-rings are insulated at 27.

In the swivels designed to accommodate fixtures in the ceiling hung configuration, the central shaft 20, and brass tube 23 have been elongated to provide adequate spacing between appendages. Because the swivel acts as a hanging rod connecting the two appendages the structural forces are carried in tension along the central shaft 20. There are little if no bending stresses along the shaft in this configuration, so its length to width ratio is not limited.

This is not the case with the swivels for the pedestal and wall mounted configurations, where in both cases the bending stresses are greater than all others. Because of these forces the central shaft 20 is made as stiff and short as possible resulting in a compact swivel design. The bearing assembly 24 utilizes roller bearings for these compact swivels because these bending forces can greatly increase rotational friction.

Figure 12:
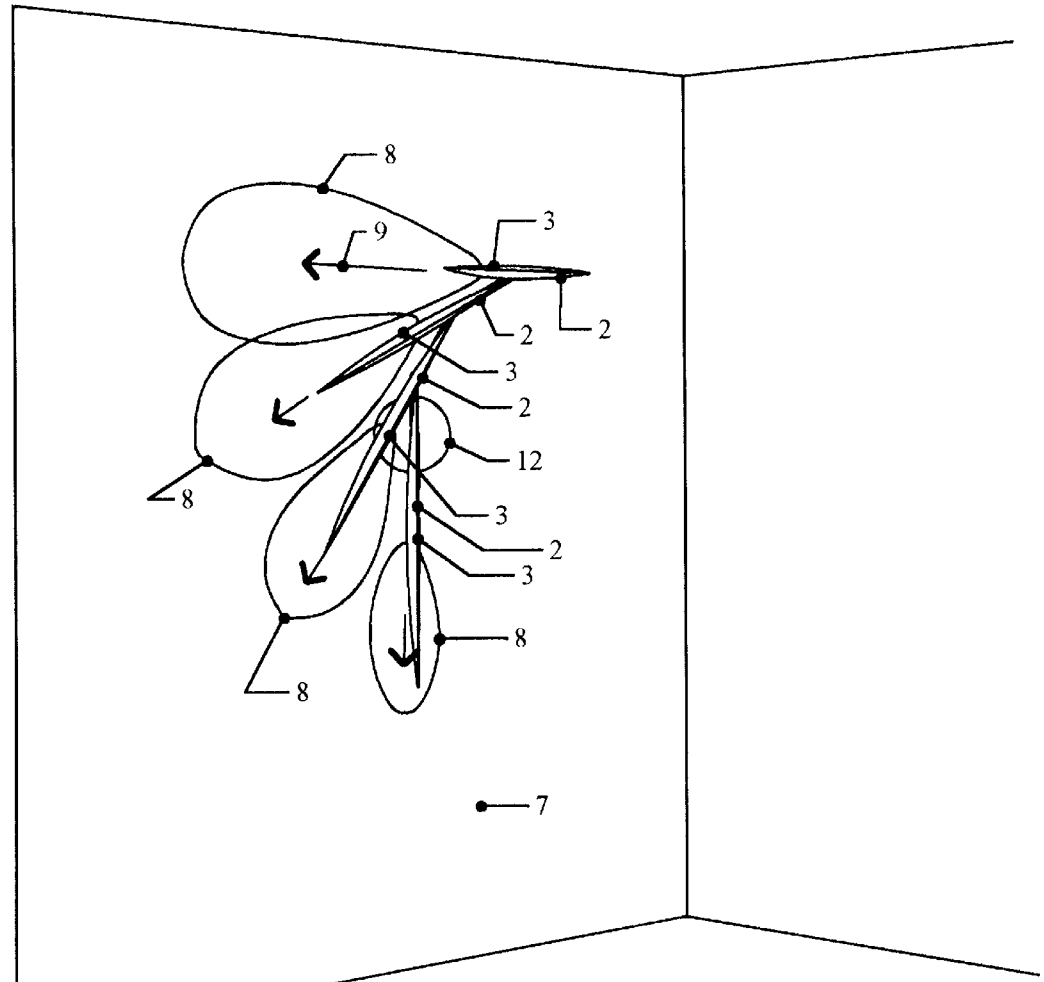
FIG. 12 is a perspective drawing of the wall mounted configuration of first embodiment showing the basic components and lighting effects.
Figure 13:
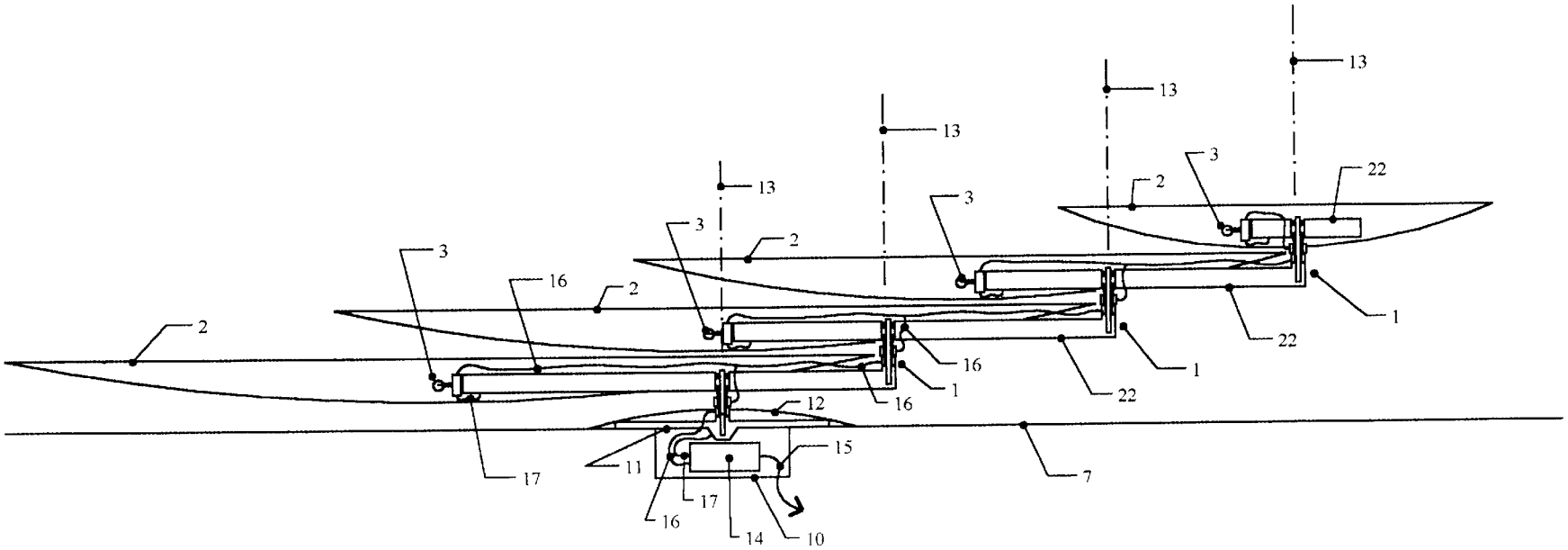
FIG. 13 is a longitudinal section of the wall mounted configuration of first embodiment showing the basic components and wiring.
Figure 14:
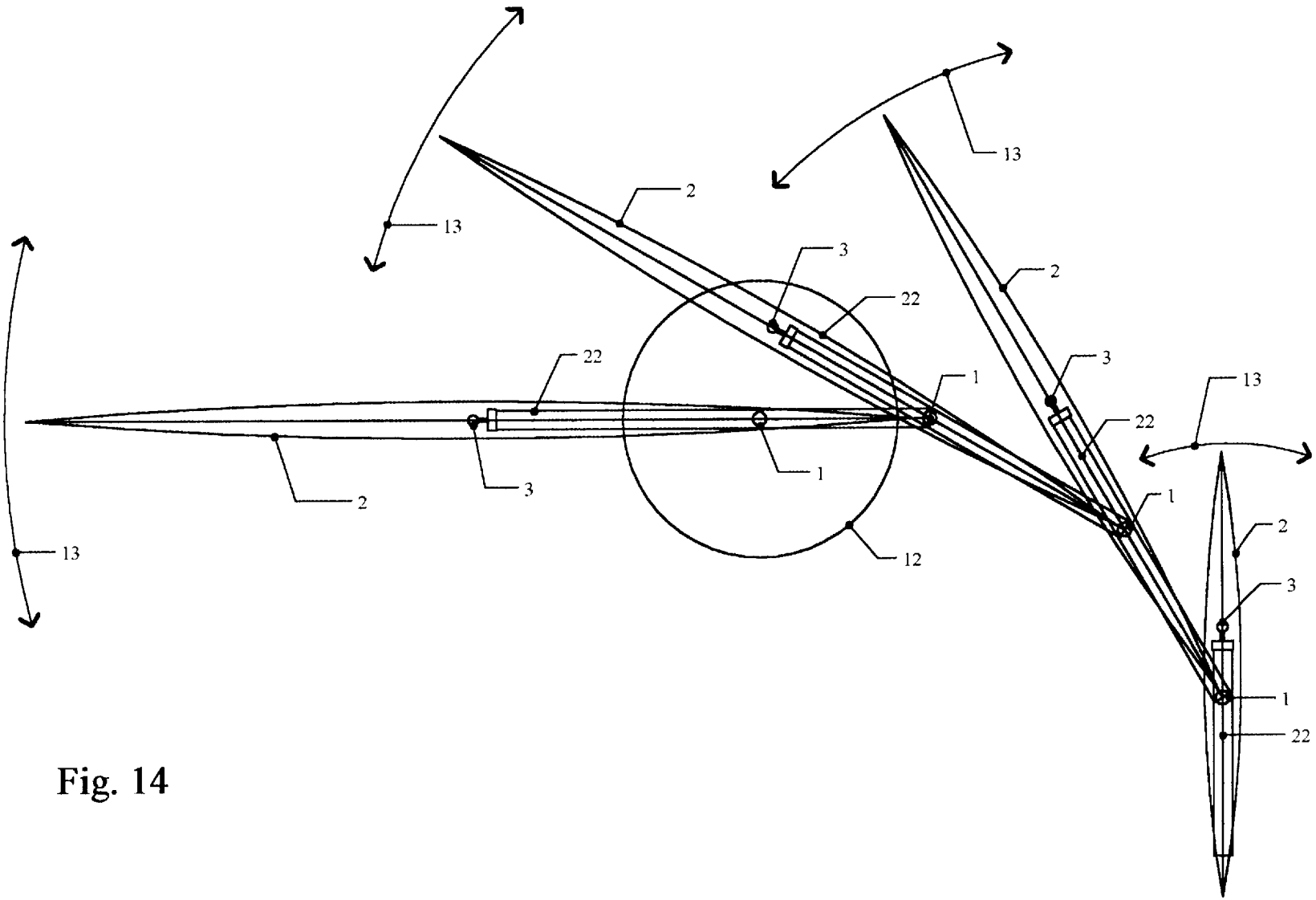
FIG. 14 is a plan view of the wall mounted configuration of first embodiment showing the basic components and rotation of the appendages.

FIGS. 12–14 shows the wall mounted configuration of the first embodiment. In this configuration the wall 7 is the surface receiving direct illumination. The major mechanical difference between the wall and ceiling versions is in the swivel design(see FIG. 9). The appendages 2 are precisely balanced about each other by an adjustment in the length of the tubular framework, and are of the same generally "V" shaped cross section as the ceiling mounted configuration.

Because the appendages 2 are precisely balanced, they orbit about each other in the same manner as the ceiling hung configuration even though gravity is now exerting itself perpendicular to the rotational axis 13. The longitudinal shape has been changed from a narrow triangle to a narrow lens shape for aesthetic purposes. The lighting 3 has been changed from spot to ambient because the bulbs are more compact, and is directed towards the wall plane as a result of the overall geometry.

Figure 15:
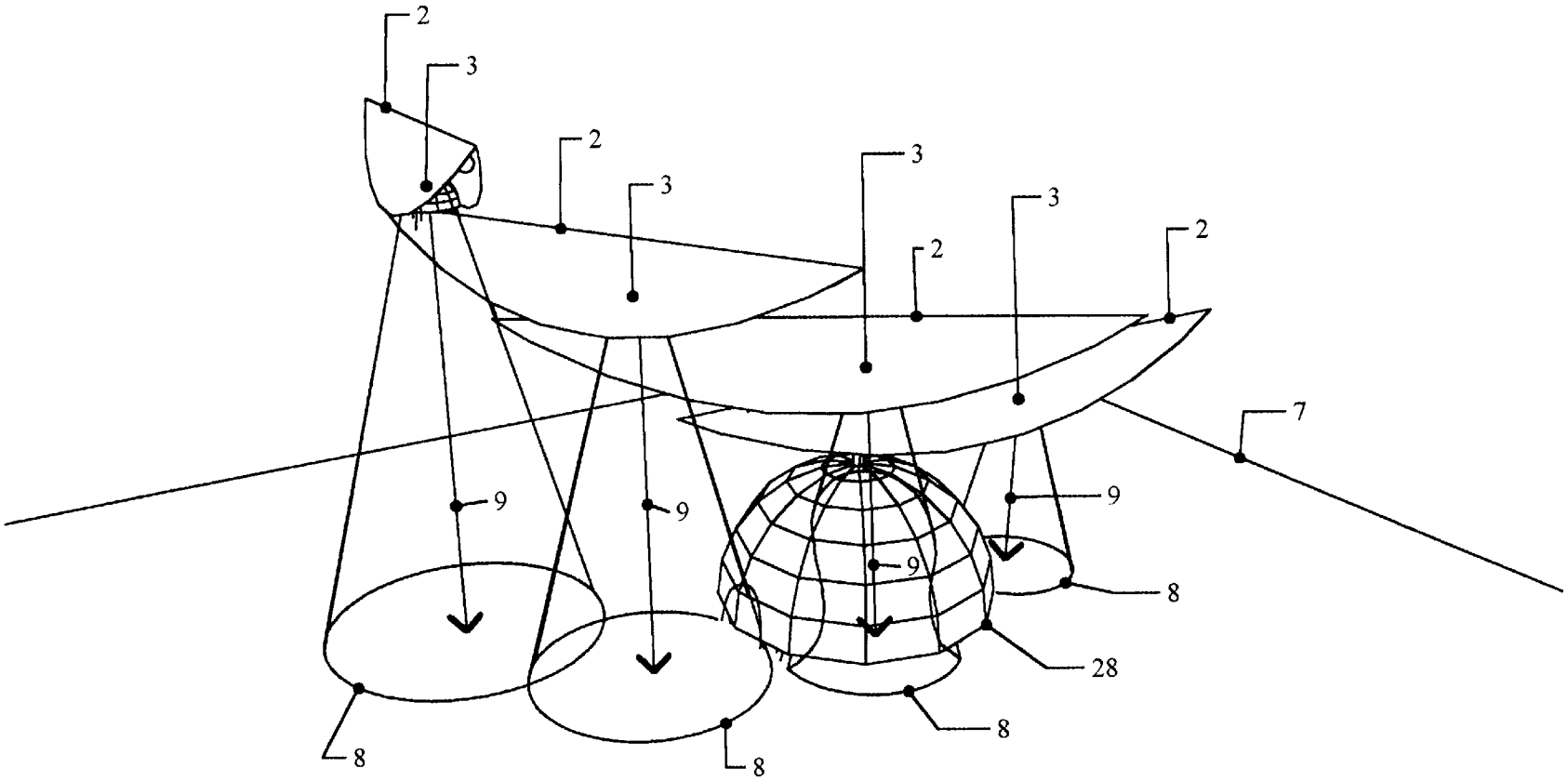
FIG. 15 is a perspective drawing of the pedestal mounted configuration of first embodiment showing the basic components and lighting effects.
Figure 16:
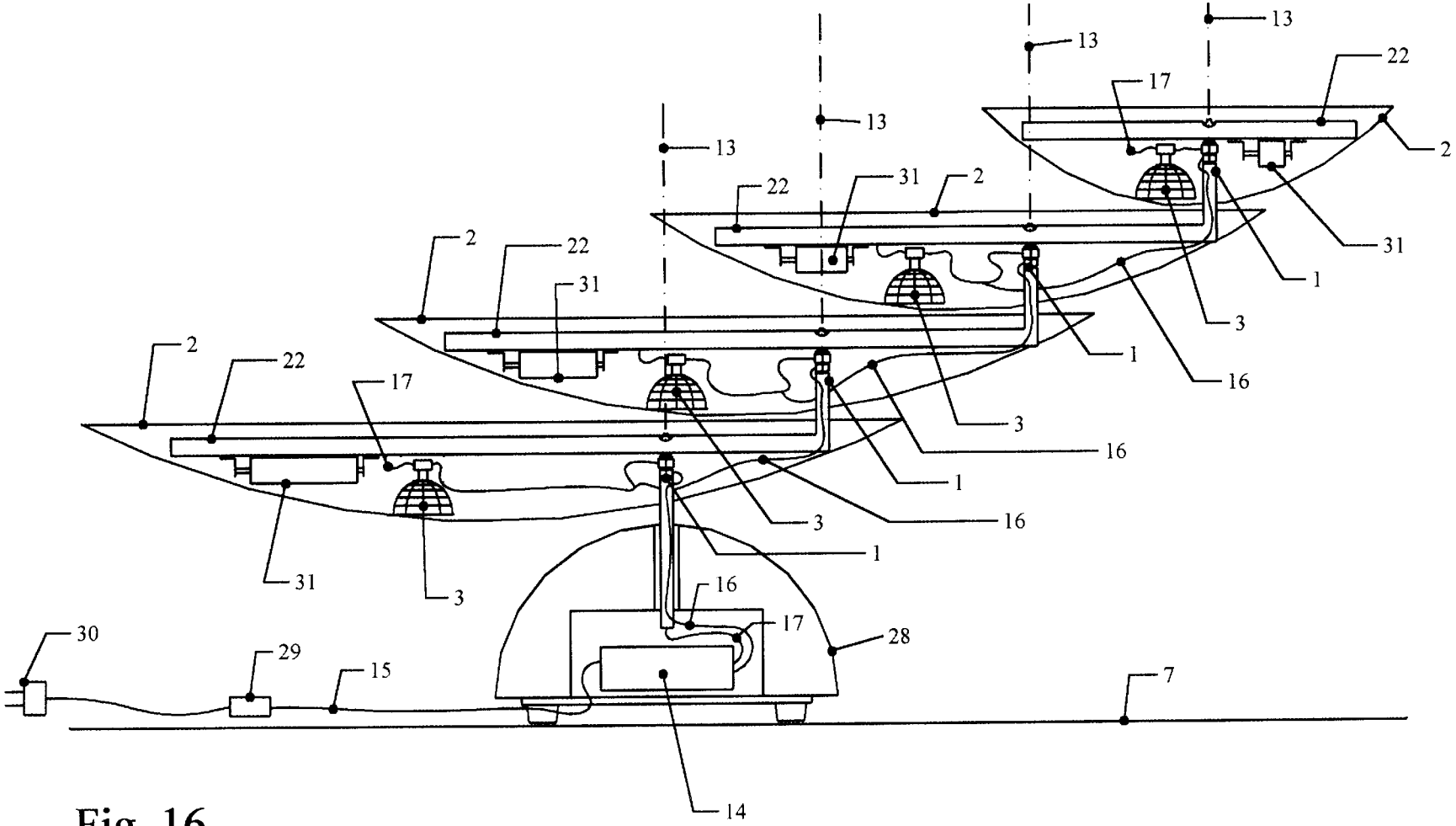
FIG. 16 is a longitudinal section of the pedestal mounted configuration of first embodiment showing the basic components and wiring.
Figure 17:
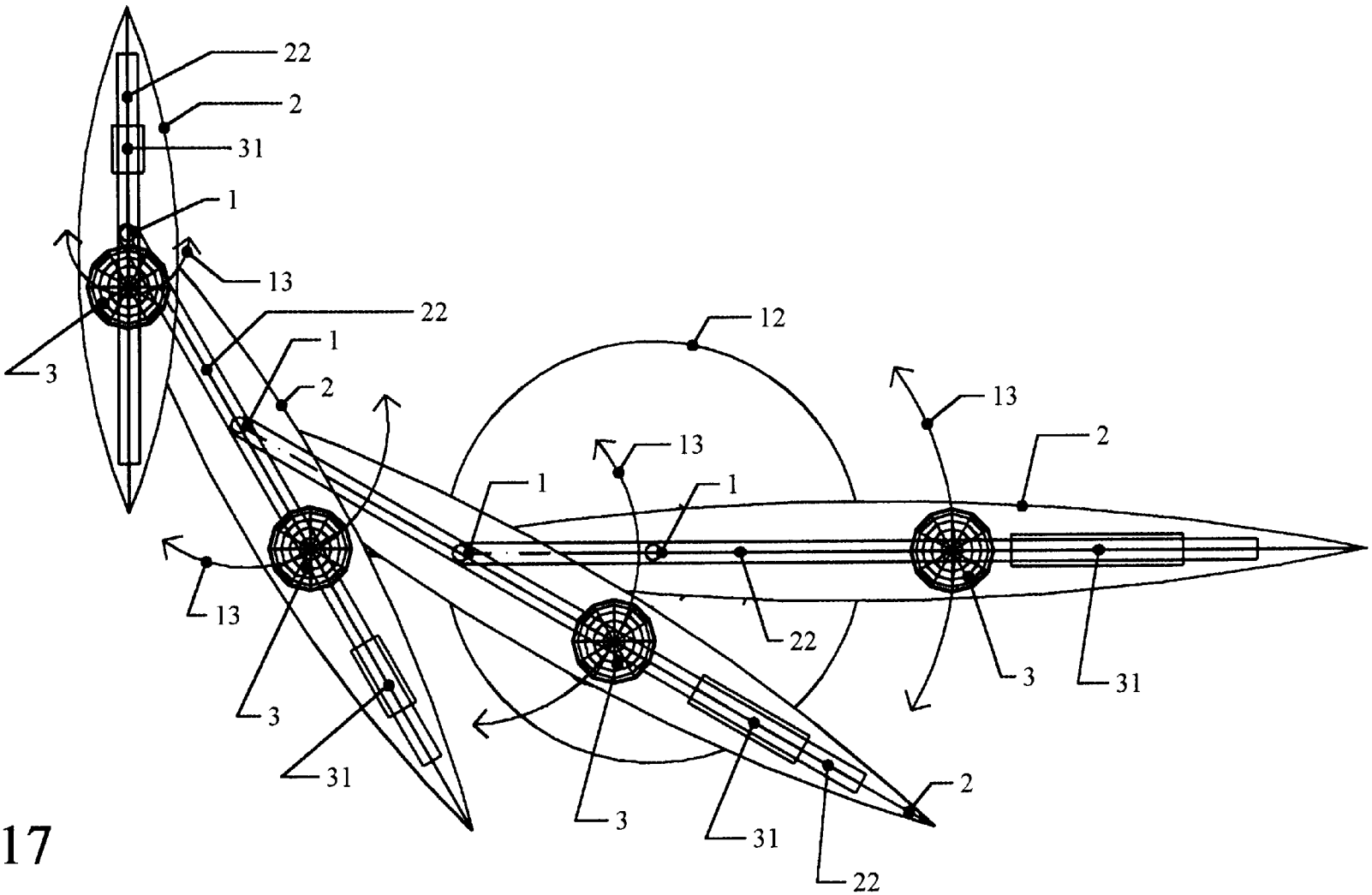
FIG. 17 is a plan view of the pedestal mounted configuration of first embodiment showing the basic components and rotation of the appendages.

FIGS. 15–17 show a pedestal mounted configuration of the first embodiment. The floor 7 is the surface receiving direct illumination. The major mechanical difference is in the swivel mechanism 1 (see FIG. 9). A pedestal base 28 made out of a heavy material such as concrete to offset the weight of the fixture that houses a 120VAC-12VDC transformer 14. 120 V AC is fed into the transformer 14 through an insulated cord 15 with an on-off switch 29 and wall plug 30.

The appendages 2 are upside down in relation to the ceiling mounted fixture, but are balanced about each and have the same shape as the wall mounted fixture. The spot lighting 3 remains unchanged, but is directed towards the floor 7 as a result of the overall geometry. The appendages 2 are precisely balanced about each other by adjusting the position of lead weights 31 concealed within the appendage 2.

Figure 18:
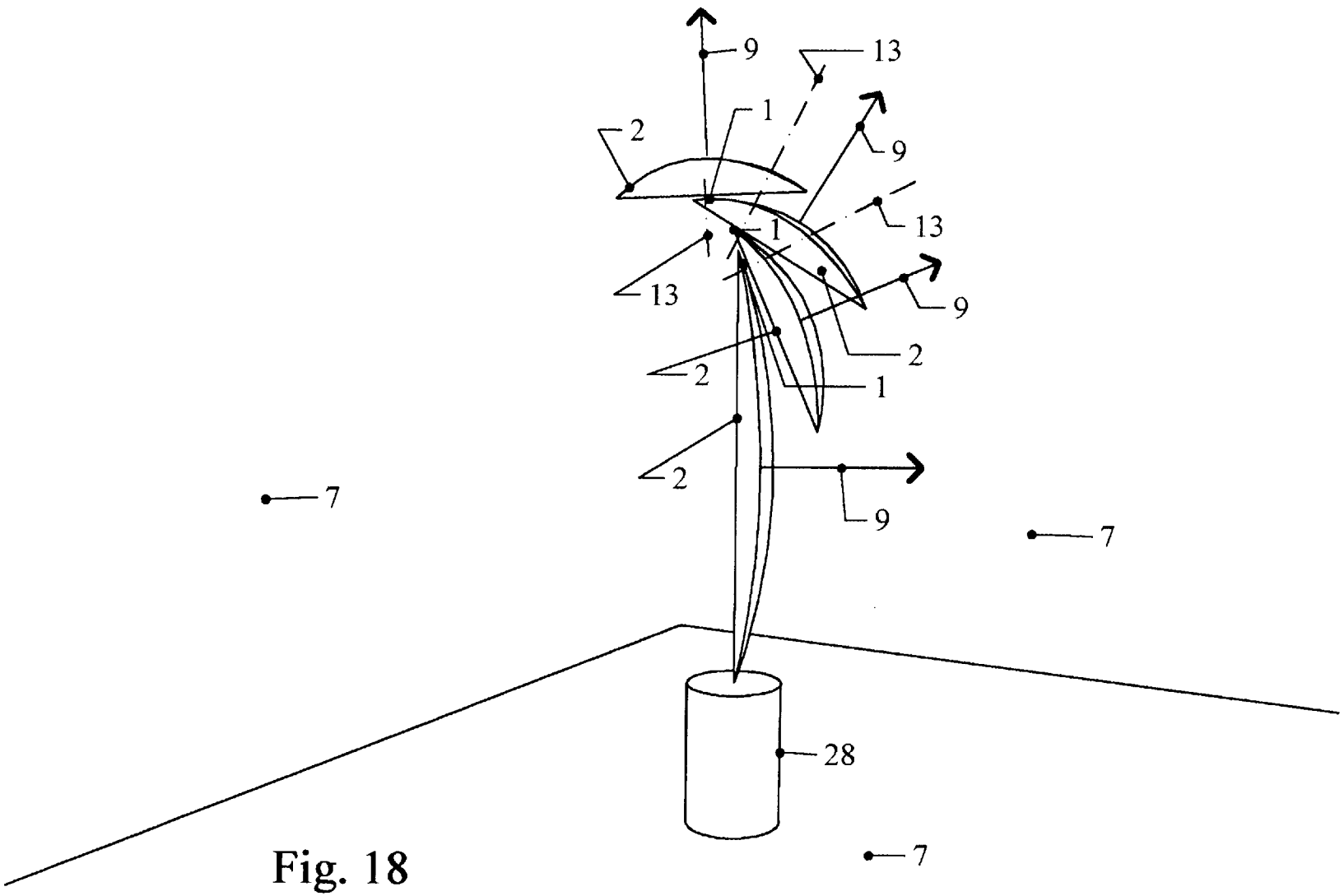
FIG. 18 is a perspective drawing of the floor mounted configuration of first embodiment showing the basic components and lighting effects.
Figure 19:
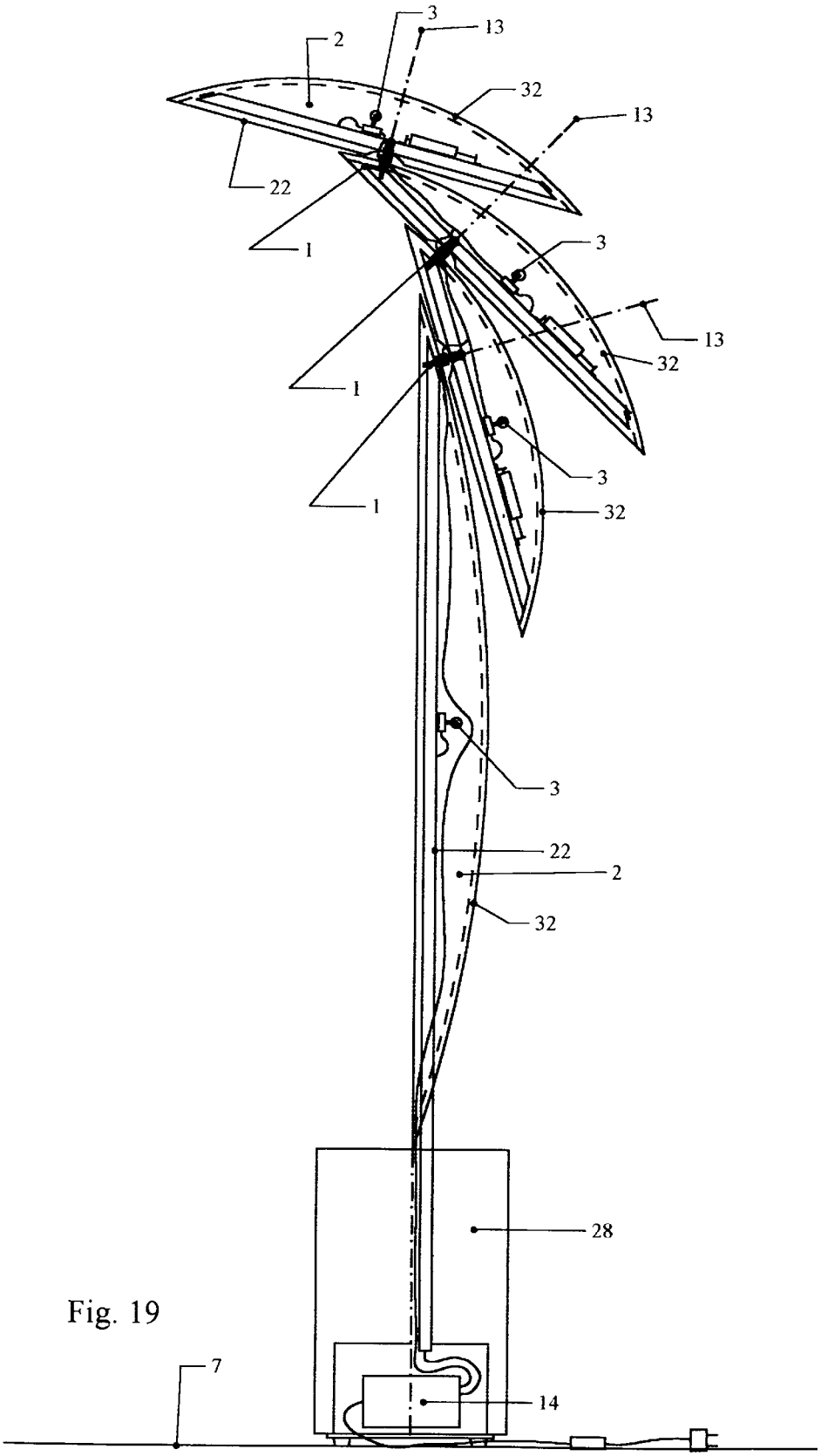
FIG. 19 is a longitudinal section of the floor mounted configuration of first embodiment showing the basic components and wiring.

FIGS. 18–19 Show a variation of the pedestal mounted configuration of the first embodiment. In this variation of FIGS. 18–19, the axis of rotation 13 of each appendage 2 is at a different angle from each other, so the rotation of each appendage occurs in an infinite amount of planes. The relationship of the appendages not only changes in the X and Y axes, but the Z as well. Light from this fixture is projected onto the walls, ceilings and floors of a space. To minimize glare, translucent light diffusing covers 32 have been placed over the open end of each V shaped appendage.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A decorative illuminating mobile apparatus comprising:

a) a support member that has an engaging surface that fits a generally flat adjacent anchoring surface;

b) a first swivel member that extends away from the support member;

c) a plurality of separately rotatable appendages that are connected together by a series of additional swivel members, at least one of the appendages being connected to the first swivel member;

d) each appendage having at least one of said swivels forming a rotating connection with another adjacent appendage;

e) at least one of the appendages including a light source that is powered by electricity;

f) an electrical supply for illuminating each light source, the electrical supply including electrical supply connections at the swivels;

g) wherein at least one of the appendages have at least two rotational connections that are spaced apart along the length of the appendage; and h) means for allowing at least one of the appendages to be moved to rotate freely by the wind.

2. The decorative illumination mobile apparatus of claim 1 wherein a plurality of the appendages has a light source.

3. The decorative illumination mobile apparatus of claim 1 wherein each appendage has a light source that is spaced away from one of the swivels on said appendage.

4. The decorative illumination mobile apparatus of claim 1 wherein each appendage has a concavity.

5. The decorative illumination mobile apparatus of claim 1 wherein each appendage has a concavity, and a light source is positioned within the concavity.

6. The decorative illumination mobile apparatus of claim 1 wherein the generally flat adjacent anchoring surface is a ceiling of a room, and the first swivel member extends downwardly from the ceiling.

7. The decorative illumination mobile apparatus of claim 1 wherein the generally flat adjacent anchoring surface is a wall of a room, and the first swivel member extends away from the wall.

8. The decorative illumination mobile apparatus of claim 1 wherein the generally flat adjacent anchoring surface is a horizontal floor surface, and the first swivel member extends upwardly from the floor surface.

9. The decorative illumination mobile apparatus of claim 1 wherein each appendage has a light source.

10. A decorative illuminating mobile apparatus comprising:

a) a support member that has an engaging surface that fits a generally flat adjacent anchoring surface;

b) a first swivel member that extends away from the support member;

c) a plurality of separately rotatable appendages that are connected together by a series of additional swivel members, at least one of the appendages being connected to the first swivel member;

d) each appendage having at least one of said swivels forming a rotating connection with another adjacent appendage;

e) at least one of the appendages including a light source that is powered by electricity;

f) an electrical supply for illuminating each light source, the electrical supply including electrical supply connections at the swivels;

g) wherein at least one of the appendages have at least two rotational connections that are spaced apart along the length of the appendage; and h) wherein each appendage is supported by a swivel member positioned at the center of gravity of the appendage.

11. The decorative illumination mobile apparatus of claim 1 wherein each appendage comprises a horizontally extending elongated member with a vertical fin at one end portion thereof.

12. The decorative illumination mobile apparatus of claim 1 wherein each appendage has a length and a width, and the length is much greater than the width.

13. The decorative illumination mobile apparatus of claim 1 wherein each of the appendages has a generally U-shaped transverse cross section.

14. The decorative illumination mobile apparatus of claim 1 wherein each of the appendages has a generally V-shaped transverse cross section, a longitudinally extending trough, and a light source positioned within the trough.

15. The decorative illumination mobile apparatus of claim 1 wherein each of the appendages is balanced in a manner to maintain a selected attitude when the appendage rotates.

16. The decorative illumination mobile apparatus of claim 1 wherein each of the appendages is free to rotated about another adjacent appendage in non-coaxial fashion.

17. A decorative illuminating mobile apparatus comprising:

a) a support member that has an engaging surface that fits a generally flat adjacent anchoring surface;

b) a first swivel member that extends away from the support member;

c) a plurality of separately rotatable appendages that are connected together by a series of additional swivel members, at least one of the appendages being connected to the first swivel member;

d) each appendage having at least one of said swivels forming a rotating connection with another adjacent appendage;

e) at least one of the appendages including a light source that is powered by electricity;

f) an electrical supply for illuminating each light source, the electrical supply including electrical supply connections at the swivels;

g) wherein at least one of the appendages have at least two rotational connections that are spaced apart along the length of the appendage;

wherein the light source is positioned to direct light to the adjacent anchoring surface and an adjacent appendage to provide an ever-changing pattern of light and shadow on the adjacent surface as the appendages rotate about one another.

18. The decorative illumination mobile apparatus of claim 17 wherein each of the appendages can be moved to rotate freely by the wind.

19. The decorative illumination mobile apparatus of claim 2 wherein each light source is powered by an electrical source that transmits power to each appendage through an electrical swivel that enables 360 degree rotation while maintaining bi-polar electrical contact.

20. A decorative illuminating mobile apparatus comprising:

a) a support member that has an engaging surface that fits a generally flat adjacent anchoring surface;

b) a first extension member that extends away from the support member;

c) a first appendage that is supported by the extension member so that the first appendage is spaced away from the support member engaging surface and the adjacent anchoring surface;

d) a plurality of appendages supported by the first appendage with a plurality of extension members including at least second and third extension members;

e) wherein the first appendage comprises an elongated member having opposed end portions, a light source, a first rotary connection that connects the first appendage to the first extension member, and a second rotary connection on the first appendage that is spaced away from the first rotary connection;

f) the second extension member extending from the second rotary connection to a second appendage, the second appendage providing a third rotary connection so that the second extension member forms rotational connections with both the first appendage and the second appendage, enabling the first and second appendages to rotate independently of each other and with respect to the support surface;

g) the second appendage having opposed end portions, a light source, and a fourth rotary connection spaced away from the third rotary connection; and h) the third extension member extending away from the fourth rotary connection to a third appendage, the third appendage providing a fifth rotary connection so that the third extension member forms rotational connections with both the second appendage and the third appendage, enabling the second and third appendages to rotate independently of each other and with respect to the support surface, wherein each of the appendages can be moved to rotate freely by the wind.

* * * * *